United States Patent [19]

Enstrom

[11] 4,339,970

[45] Jul. 20, 1982

[54] SERVICEABLE RELEASABLE SOCKET RETAINING RATCHET

[76] Inventor: Rudolph J. Enstrom, 1520 M 69 Hwy., Crystal Falls, Mich. 49920

[21] Appl. No.: 195,744

[22] Filed: Oct. 10, 1980

[51] Int. Cl.[3] ..... B25B 13/46

[52] U.S. Cl. ..... 81/60; 81/177 G

[58] Field of Search ..... 81/60-63.2, 81/177 G; 403/325, 328, 330

[56] References Cited

U.S. PATENT DOCUMENTS

| | | | |
|---|---|---|---|
| 3,762,245 | 10/1973 | Smyers et al. | 81/177 G |
| 3,777,596 | 12/1973 | Smyers et al. | 81/177 G |
| 4,187,747 | 2/1980 | Pawlow | 81/177 G |

*Primary Examiner*—James L. Jones, Jr.

*Attorney, Agent, or Firm*—Harry M. Weiss

[57] ABSTRACT

This disclosure relates to a ratchet type wrench which incorporates a totally disassemblable socket retaining apparatus so that the ratchet can be disassembled for cleaning and service.

7 Claims, 5 Drawing Figures

SERVICEABLE RELEASABLE SOCKET RETAINING RATCHET

BACKGROUND OF THE INVENTION

1. Field of the Invention

This invention relates generally to socket wrenches, and, more particularly, to ratchet-type wrenches which are provided with a mechanism for retaining a socket in place on the drive lug of the ratchet.

2. Description of the Prior Art

In the past, ratchet-type wrenches have found widespread application for the installation and removal of threaded fasteners such as nuts and bolts. Typically, ratchet wrenches have utilized a square drive lug which engages a corresponding opening in a socket, or such other tool as is being driven. Since mechanical service operations are typically performed with less than adequate access to the apparatus being serviced, it was often necessary to manipulate the ratchet-socket combination with a single hand. Without a mechanism to retain the socket on the drive lug, the socket often fell away from the ratchet under the force of gravity. This problem was particularly acute when heavy sockets or extensions were coupled to the drive lug of the ratchet.

Subsequently, a spring-loaded ball was mounted within a lateral aperture in the drive lug, and sockets were equipped with corresponding internal detents which could receive the spring-loaded ball to retain the socket in place. Such a configuration, however, made removal of the socket from the drive lug difficult, particularly when the respective tools were coated with oil or grease, as was typically the case.

At an even later date, a release mechanism was incorporated into ratchets, to permit the spring load against the socket-retaining ball to be released by depressing a button accessible from the back of the ratchet. However, although ratchets, which are subjected to various dirt, oil and grease contaminants during their working life, had normally been constructed so as to permit complete disassembly for cleaning and service, the release mechanism-equipped ratchets could only be partially disassembled, and they made no provision for servicing all of the parts which functioned as the spring-load-release mechanism. A need existed for a ratchet wrench which could retain a socket, selectively release the socket, and still be conveniently disassembled to clean and service the internal operating parts.

SUMMARY OF THE INVENTION

In accordance with one embodiment of this invention, it is an object to provide a disassemblable, releasable socket-retaining ratchet mechanism.

It is another object to provide a disassemblable, releasable socket-retaining ratchet mechanism which is totally field serviceable.

It is a further object to provide a disassemblable, releasable socket-retaining ratchet mechanism which does not require a strength-reducing lateral aperture in the drive lug for the socket retaining mechanism.

It is still another object to provide a disassemblable releasable socket-retaining ratchet mechanism which is low in cost.

DESCRIPTION OF THE PREFERRED EMBODIMENTS

In accordance with one embodiment of this invention, a serviceable, releasably socket-retaining ratchet is disclosed, comprising: drive lug means for transmitting torque to the socket; ratchet means for reversible ratchetably rotating the drive lug means; and totally removable retaining means for selectively coupling the socket to the drive lug means.

In accordance with another embodiment of this invention, a method of releasably retaining a socket on a drive lug of a socket-type wrench is disclosed, comprising the steps of: privotally suspending a shank member centrally disposed within the drive lug of the wrench from a button member; providing the shank member with a nose portion disposed to contact the interior of the socket; and biasing the button member to translate the shank member to contact a cam follower surface of the shank member against a cam surface of the drive lug so that the nose portion is thereby biased against the interior of the socket.

The foregoing and other objects, features and advantages of this invention will be apparent from the following more particular description of the preferred embodiments of the invention as illustrated in the accompanying drawings.

Figure 1:
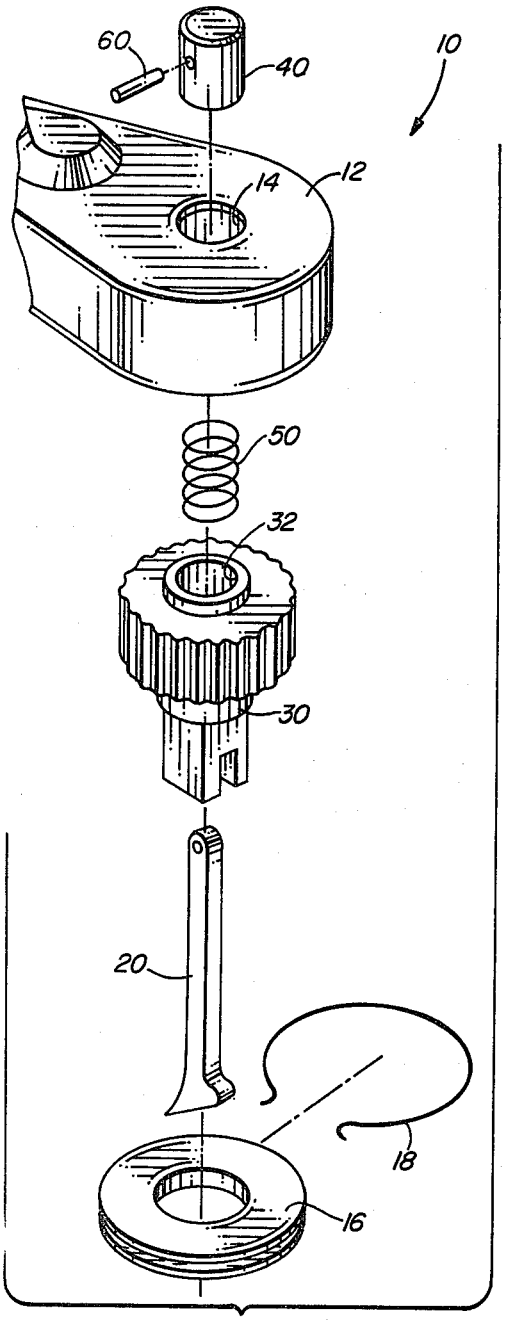
FIG. 1 is an exploded perspective view of the internal workings of a disassemblable, releasable socket-retaining ratchet.

Referring to FIG. 1, an exploded view of a fully serviceable, socket-retaining ratchet is shown generally by reference number 10. The respective portions are shown removed from the ratchet head 12, which incorporates a reversible ratchet mechanism of conventional construction to engage the teeth of a drive lug member 30. Specifically, the serviceable ratchet 10 includes a shank member 20, the drive lug member 30 which has an internal aperture 31 (refer to FIG. 2) through which the shank member 20 passes, a button 40 which protrudes from an aperture 14 in the ratchet head 12 and which can be selectively depressed into a button aperture 32 in the drive lug member 30, a spring 50 which is normally captivated between the button 40 and the drive lug member 30, a spring 50 which is normally captivated between the button 40 and the drive lug member 30, and a pin 60 which removably suspends the shank member 20 from the button 40. The serviceable ratchet 10 is also provided with a drive lug retaining plate 16, which in use is held in place in the conventional manner by a spring clip 18. Removal of the spring clip 18 and the pin 60 allow the entire ratchet 10 to be disassembled as shown, for inspection, cleaning, lubrication and repair.

Figure 2:
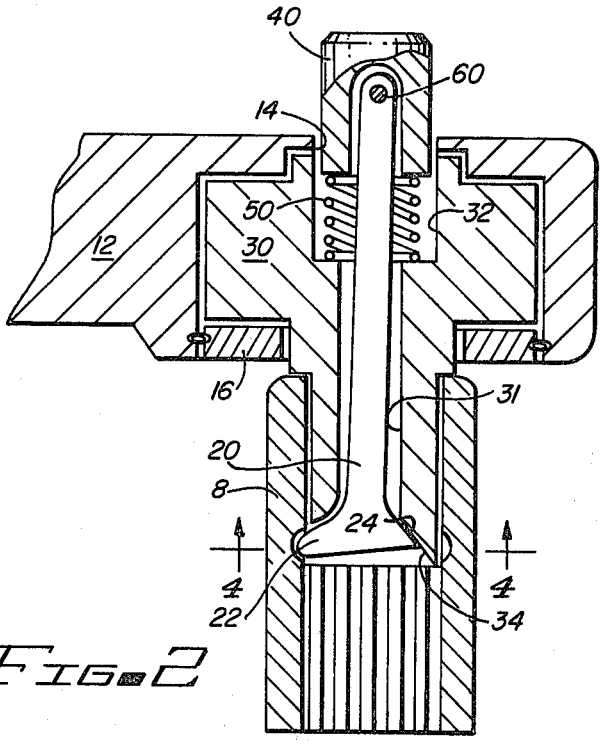
FIG. 2 is a sectional elevational view of a disassemblable, releasable socket-retaining ratchet coupled to a socket.

Referring then to FIG. 2, the serviceable ratchet 10 is shown retentively engaging a socket 8. It can be seen that the serviceable ratchet 10 is provided with a totally removable retaining, or latch, apparatus for selectively coupling the socket 8 to the drive lug member 30. The retaining apparatus includes the shank member 20, which is provided with a nose portion 22 disposed to communicate with the interior surface of the socket 8. The retaining apparatus also includes a cam follower surface 24 on the shank member 20 (refer also to FIG. 3), which can contact a corresponding cam surface 34 defined at a socket-engaging end of the drive lug member 30. Since there are no lateral apertures required through the drive lug member 30, an extremely rugged construction is provided.

Figure 3:
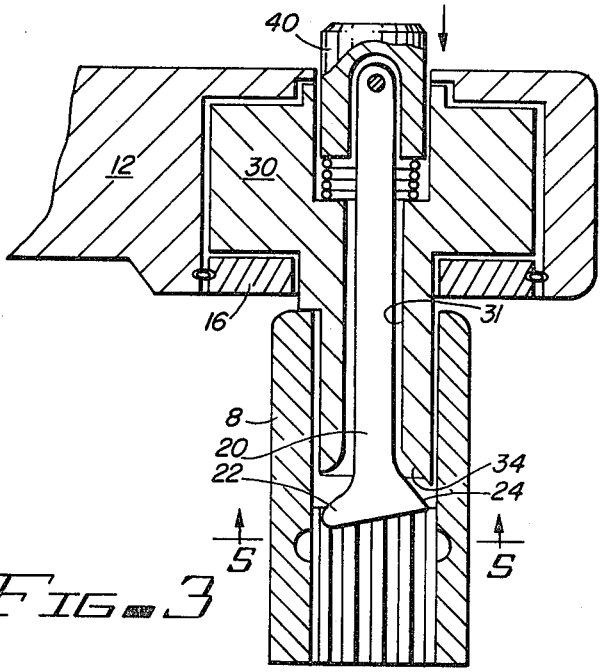
FIG. 3 is a sectional elevational view of a disassemblable, releasable socket-retaining ratchet released from a socket.

Referring further to FIG. 3, the serviceable ratchet 10 is shown with the button 40 depressed, which both compresses the spring 50, and also translates the shank 20 to move the cam follower surface 24 away from the cam surface 32. Shifting the cam follower surface 24 away from the cam surface 34 releases the bias, towards socket 8, upon the nose portion 22 of the shank member 20 and allows a separation of the socket 8 from the ratchet 10 under the force of gravity or such other force as might be applied by one wishing to remove the socket 8.

Figure 4:
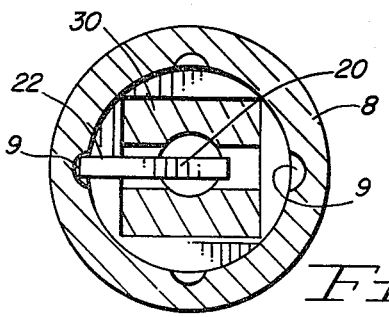
FIG. 4 is a sectional view taken along line 4—4 of FIG. 2.

Referring then to FIG. 4, a sectional view taken along line 4—4 of FIG. 2 is shown. The nose portion 22 of the shank member 20 is shown in communication with the interior surface of the socket 8, and more particularly is shown engaging one of a plurality of internal detents 9 in the socket 8. Such detents 9 are typically provided to permit the socket 8 to be retained by a conventional spring-loaded ball, mounted within a lateral aperture in a drive lug otherwise generally similar to drive lug member 30. Since the ratchet 10 is equipped with a socket retaining apparatus which does not require such a lateral aperture, a substantially stronger lug member 30 is thereby provided.

Figure 5:
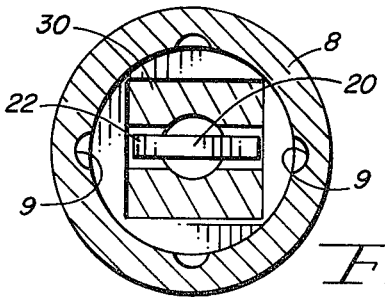
FIG. 5 is a sectional view taken along line 5—5 of FIG. 3.

Referring to further to FIG. 5, a sectional view taken along line 5—5 of FIG. 3 is shown. The nose portion 22 of the shank member 20 is shown spaced from the interior surface of the socket 8, as would occur when the button 40 is depressed as shown in FIG. 3 to release the socket 8.

While the invention has been particularly described and shown in reference to the preferred embodiments thereof, it will be understood by those skilled in the art that various changes in form and detail and omissions may be made therein without departing from the spirit and scope of the invention.

What is claimed is:

1. A serviceable, releasable socket retaining ratchet, comprising:

drive lug means for transmitting torque to said socket;

ratchet means for reversibly ratchetably rotating said drive lug means;

totally removable retaining means for selectively coupling said socket to said drive lug means;

said retaining means comprising latch means for biasing a nose against the interior of said socket;

said retaining means further comprising button means for releasing the bias upon said latch member;

said latch means including said drive means having a longitudinal internal aperture provided with a cam surface at an end proximal to said socket;

said latch means having a shank member passing through said internal aperture;

said shank member having a pivotal coupling to said button means; and said shank member further having a head provided with said nose disposed to selectively contact said socket and also having a cam follower surface disposed to contact said cam follower surface when said button means is released so that said nose is biased toward said socket.

2. A ratchet in accordance with claim 1 wherein said button means comprising:

a button lying within said longitudinal internal aperture;

said button having said pivotal coupling to said shank member; and spring means for biasing said button away from said socket so that said cam follower surface is thereby biased toward said cam surface.

3. A ratchet in accordance with claim 2 wherein said button further having a portion protruding from said ratchet so that said button can be manually depressed to separate said cam follower surface from said cam surface.

4. A ratchet in accordance with claim 3 wherein said spring means comprising a compression spring located between said button and said drive lug means.

5. A ratchet in accordance with claim 4 wherein said pivotal coupling comprising:

said button having a lateral aperture in said protruding region;

said shank member having an aperture in an end remote from said cam follower surface; and a pin passing through both said button aperture and said shank aperture so that the removal of said pin permits said button, said spring and said shank member to each be removed from said longitudinal internal aperture.

6. A method of releasably retaining a socket mounted on a drive lug of a socket-type ratchet wrench, comprising the steps of:

pivotally suspending a shank member centrally disposed within said drive lug of said wrench from a button member;

providing said shank member with a nose portion disposed to contact the interior of said socket; and biasing said button member to contact a cam follower surface of said shank member against a cam surface of said drive lug so that said nose portion is thereby biased against the interior of said socket.

7. A method of releasably retaining a socket in accord with claim 6, further comprising the step of depressing said button member to space said cam follower surface from said cam surface to release the bias on said nose portion against the interior of said socket so that said socket is released.

* * * * *